US008744290B2

(12) United States Patent
Choi

(10) Patent No.: US 8,744,290 B2
(45) Date of Patent: Jun. 3, 2014

(54) APPARATUS AND METHOD OF PROTECTING FUSER UNIT AND IMAGE FORMING APPARATUS INCLUDING THE SAME

(75) Inventor: Seung-young Choi, Seoul (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 128 days.

(21) Appl. No.: 13/351,498

(22) Filed: Jan. 17, 2012

(65) Prior Publication Data

US 2012/0183312 A1 Jul. 19, 2012

(30) Foreign Application Priority Data

Jan. 18, 2011 (KR) ..... 10-2011-0005090

(51) Int. Cl.
*G03G 15/20* (2006.01)

(52) U.S. Cl.
USPC ..... 399/33; 399/67

(58) Field of Classification Search
USPC ..... 399/33
See application file for complete search history.

(56) References Cited

U.S. PATENT DOCUMENTS

| | | | | |
|---|---|---|---|---|
| 5,982,503 | A * | 11/1999 | Miyamoto et al. | 358/400 |
| 2004/0258427 | A1 | 12/2004 | Takahashi | |
| 2005/0248648 | A1 * | 11/2005 | Suzuki | 347/116 |
| 2007/0166067 | A1 * | 7/2007 | Noguchi et al. | 399/69 |

FOREIGN PATENT DOCUMENTS

| | | |
|---|---|---|
| JP | 6-202522 | 7/1994 |
| JP | 2003-270982 | 9/2003 |
| JP | 2004-013020 | 1/2004 |
| JP | 2004-341177 | 12/2004 |
| JP | 2008-209718 | 9/2008 |
| JP | 2010-146028 | 7/2010 |

OTHER PUBLICATIONS

Extended European Search Report dated May 8, 2012 issued in EP Application No. 12151373.3.

* cited by examiner

*Primary Examiner* — Clayton E Laballe
*Assistant Examiner* — Jas Sanghera
(74) *Attorney, Agent, or Firm* — Stanzione & Kim, LLP

(57) ABSTRACT

An apparatus and method of protecting a fuser unit and an image forming apparatus having the same include a fuser drive motor portion to drive the fuser unit, a power detecting portion to detect power that is supplied to the fuser unit, and a power cutoff portion to cut off the power supplied to the fuser unit when a motor rotation signal is not output from the fuse drive motor portion and the power detecting portion detects the power that is supplied to the fuser unit. The fuser unit protecting apparatus and method and the image forming apparatus including the fuser unit protecting apparatus are configured to detect rotation of a fuser drive motor and supply of an alternating current required for a temperature rise and cut off the power supply when abnormal conditions occur, to prevent a continuous rise in a temperature of the fuser unit as well as deformation thereof.

16 Claims, 7 Drawing Sheets

APPARATUS AND METHOD OF PROTECTING FUSER UNIT AND IMAGE FORMING APPARATUS INCLUDING THE SAME

CROSS-REFERENCE TO RELATED PATENT APPLICATION

This application claims priority under 35 U.S.C. §119 from Korean Patent Application No. 10-2011-0005090, filed on Jan. 18, 2011, in the Korean Intellectual Property Office, the disclosure of which is incorporated herein in its entirety by reference.

BACKGROUND OF THE INVENTION

1. Field of the Invention

The present general inventive concept relates to an image forming apparatus, and more particularly, to an apparatus and method of protecting a fuser unit capable of preventing deformation of a fuser unit that may occur during an abnormal operation by monitoring an operation state of the fuser unit, and an image forming apparatus including the apparatus to protect the fuser unit.

2. Description of the Related Art

A fuser unit for an eletrophotographic image forming apparatus, such as a laser beam printer (LBP), a photocopier, and a facsimile, fixes a toner image to a sheet of paper using heat generated by a lamp to which an alternating current (AC) voltage is applied. Thus, in order to maintain a lifetime of a fuser unit or prevent deformation of the fuse unit due to heat, the fuser unit has a built-in temperature sensing element. Furthermore, when the fuser unit operates above a tolerable operating temperature and is determined to be operating abnormally, regardless of control by a software circuit unit, a control circuit forcibly cuts off AC power and current supply, thereby preventing a temperature of the fuser unit from continuously rising and also preventing deformation of the fuser unit.

In a conventional image forming apparatus, under abnormal conditions that cannot be controlled by a control circuit, a hardware protection circuit unit may be additionally provided to cut off AC power applied to a fuser unit to stop a temperature of the fuser unit from rising, thereby preventing or suppressing deformation of the fuser unit.

To achieve this, the conventional image forming apparatus is configured to monitor a temperature detected by a temperature sensor on a surface of a belt within the fuser unit and cause the hard protection circuit to operate when the detected temperature exceeds a preset tolerable temperature.

However, the conventional image forming apparatus may have two problems associated with the protection of the fuser unit. In detail, when the belt in the fuser unit continues to rotate by a motor driving the fuser unit or ceases to rotate, the hardware protection circuit is configured to work if the fuser unit is heated due to abnormal reasons so that the temperature of the fuser unit reaches a preset tolerable temperature. In this case, even if heat generated by a heat source is prevented, latent heat is not uniformly applied to a belt surface, and thus the belt surface may be adversely affected. Another drawback is that a temperature overshoot may occur. More specifically, in order to minimize a First Page Out Time (FPOT), heating characteristics of a lamp/belt/roller within the fuser unit are improved, and a fusing temperature rising speed is increased so that the temperature of the fuser unit reaches a target fusing temperature as fast as possible. However, when the fuser unit is heated to the tolerable temperature and the hardware protection circuit begins to operate, a temperature overshoot may occur even if the heat source is prevented from generating heat. That is, as a fusing temperature rising slope becomes steeper, latent heat applied to the surface of the belt within the fuser unit causes the temperature of the fuser unit to rise above the target temperature before dropping back to the target temperature.

The above two problems may cause a significant overshoot even after preventing release of heat by a heat source with a hardware protection circuit simply having a temperature sensing function. Such a large overshoot will lead to deformation of a belt surface or within a fuser unit.

SUMMARY OF THE INVENTION

The present general inventive concept provides an apparatus and method of protecting a fuser unit to detect whether a motor for the fuser unit ceases to rotate and whether a flow of current is detected in a loop circuit of a lamp in the fuser unit to which an alternating current is applied, and if the two conditions occur simultaneously, to determine the simultaneous occurrence as abnormal and cut off alternating current power supply.

The present general inventive concept also provides an image forming apparatus having the apparatus to protect the fuser unit.

Additional aspects and advantages of the present general inventive concept will be set forth in part in the description which follows and, in part, will be obvious from the description, or may be learned by practice of the general inventive concept.

The above and/or other features and utilities of the present general inventive concept may be achieved by providing an apparatus to protect a fuser unit usable in an image forming apparatus, the apparatus including: a fuser drive motor portion to drive the fuser unit, a power detecting portion to detect power that is supplied to the fuser unit, and a power cutoff portion to cut off the power supplied to the fuser unit when the fuse drive motor portion does not output a motor rotation signal and the power detecting portion detects the power that is supplied to the fuser unit. The fuser circuit protecting apparatus may further include a power supply supplying power to the fuser unit and a switching element that is controlled by the power cutoff portion and switches on and off the power supplied to the fuser unit. The switching element is a relay that is set switched off by a default operation.

The apparatus may further include a rotation sensor to detect rotation of one of a heat roller, a pressure roller, and a heating film, a power detecting portion to detect power that is supplied to the fuser unit, and a power cutoff portion to cut off the power supplied to the fuser unit when the rotation sensor does not detect the rotation and the power detecting portion detects the power that is supplied to the fuser unit. The apparatus may further include a power supply to supply power to the fuser unit and a switching element controlled by the power cutoff portion to switch on and off the power supplied from the power supply to the fuser unit. The switching element is a relay that is set switched on by a default operation.

The apparatus may further include a switching element to switch on and off power supplied from a power supply to the fuser unit and to be set to switch off by a default operation, a fuser drive motor portion to drive the fuser unit, and a switching element controller to control the switching element so as to supply the power to the fuser unit when a motor rotation signal is output from the fuser drive motor portion and to control the switching element so as not to supply the power to the fuser unit when the motor rotation signal is not output from the fuser drive motor portion.

The apparatus may include a rotation sensor to detect rotation of one of a fuser belt, a pressure roller, and a heating film, a switching element to switch on and off power supplied from the power supply to the fuser unit, and a power cutoff portion to cut off the power supplied to the fuser unit when the rotation is not detected by the rotation sensor.

The above and/or other features and utilities of the present general inventive concept may also be achieved by providing an image forming apparatus including a fuser unit to fuse an image onto a printing medium, a power supply to supply power to the fuser unit, a switching element to switch on and off the power supplied from the power supply to the fuser unit, a fuser drive motor portion to drive the fuser unit, a power detecting portion to detect power supplied to the fuser unit, and a power cutoff portion to cut off the power supplied to the fuser unit when a motor rotation signal is not output from the fuse drive motor portion and the power detecting portion detects the power that is supplied to the fuser unit.

The above and/or other features and utilities of the present general inventive concept may also be achieved by providing an image forming apparatus including a fuser unit to fuse an image onto a printing medium, a power supply to supply power to the fuser unit, a switching element to switch on and off the power supplied from the power supply to the fuser unit, a rotation sensor to detect rotation of one of a heat roller, a pressure roller, and a heating film, a power detecting portion to detect power supplied to the fuser unit, and a power cutoff portion to control the switching element to cut off the power supplied to the fuser unit when the rotation is not detected by the rotation sensor and the power detecting portion detects the power that is supplied to the fuser unit.

The above and/or other features and utilities of the present general inventive concept may also be achieved by providing an image forming apparatus including a fuser unit to fuse an image onto a printing medium, a power supply to supply power to the fuser unit, a switching element to switch on and off power that is supplied from the power supply to the fuser unit, a fuser drive motor portion to drive the fuser unit, and a switching element controller to control the switching element so as to supply the power to the fuser unit when a motor rotation signal is output from the fuser drive motor portion and to control the switching element so as not to supply the power to the fuser unit when the motor rotation signal is not output from the fuser drive motor portion.

The above and/or other features and utilities of the present general inventive concept may also be achieved by providing an image forming apparatus including a fuser unit to fuse an image onto a printing medium, a power supply to supply power to the fuser unit, a rotation sensor to detect rotation of one of a fuser belt, a pressure roller, and a heating film, a switching element to switch on and off power that is supplied from the power supply to the fuser unit, and a power cutoff portion to cut off the power supplied to the fuser unit when the rotation is not detected by the rotation sensor.

The above and/or other features and utilities of the present general inventive concept may be achieved by providing a method of protecting a fuser unit in an image forming apparatus, the method including detecting whether a motor in a fuser drive motor portion rotates, detecting power that is supplied to the fuser unit, and cutting off the power supplied to the fuser unit when the motor ceases to rotate and the power is supplied to the fuser unit. The detecting whether the motor rotates may include detecting rotation of one of a belt, a pressure roller, and a heat roller by the fuser drive motor portion.

The above and/or other features and utilities of the present general inventive concept may be achieved by providing an apparatus and method of protecting a fuser unit and an image forming apparatus using the same, the apparatus configured to detect rotation of a fuser drive motor and supply of an AC current required for a temperature rise of the fuser unit and cut off the power supply when abnormal conditions occur, thereby preventing a continuous rise in the temperature of the fuser unit as well as deformation thereof.

The above and/or other features and utilities of the present general inventive concept may be achieved by providing a method of protecting a fuser unit in an image forming device, the method including detecting movement of the fuser unit and power supplied to the fuser unit, and cutting off the power supplied to the fuser unit according to the detected movement and power.

The above and/or other features and utilities of the present general inventive concept may be achieved by providing an apparatus to protect a fuser unit in an image forming apparatus, the apparatus including a detecting unit to detect detecting movement of the fuser unit and power supplied to the fuser unit, and a controller unit to cut off the power supplied to the fuser unit according to the detected movement and power.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
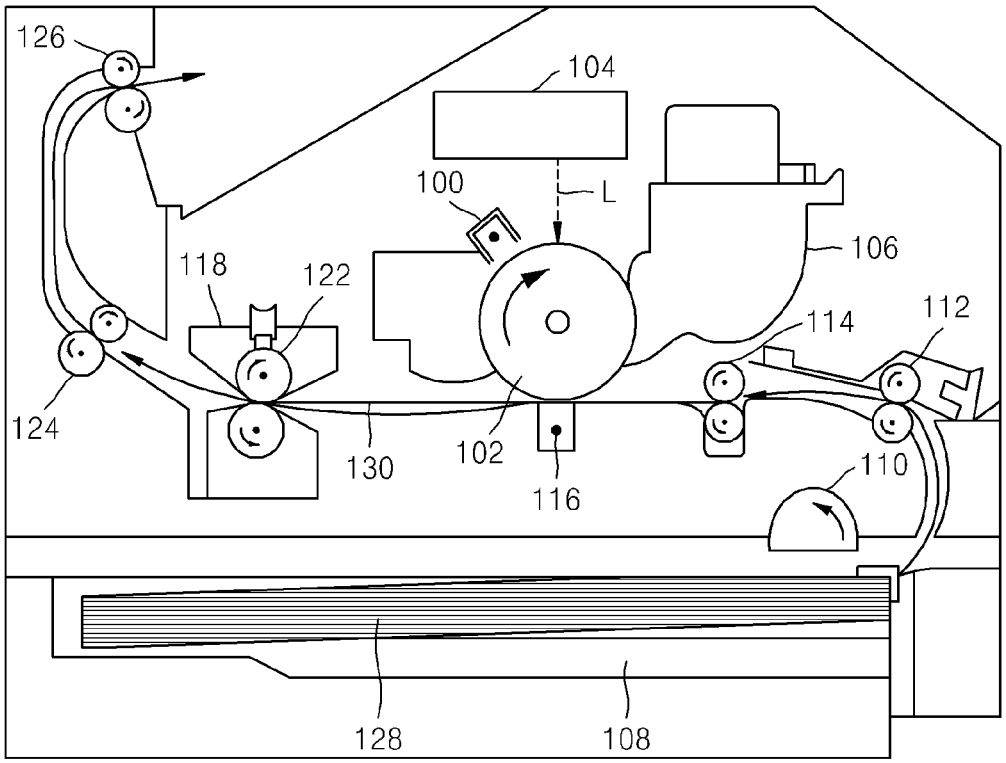
FIG. 1 (RELATED ART)
FIG. 1 is a view illustrating an image forming apparatus.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

The detailed description set forth below and constructions shown in the drawings are intended to be a description of exemplary embodiments of the general inventive concept and are not intended to represent the only forms in which the general inventive concept will be constructed. That is, it is to be understood that equivalent alternatives or modifications will be easily conceivable for those skilled in the art at the time of the general inventive concept. An image forming apparatus, such as a laser beam printer (LBP), a photocopier, and a facsimile, adopts an electrophotographic printing method. The electrophotographic printing method includes several consecutive processes including charging, light exposure, development, transfer, and fusing.

FIG. 1 schematically illustrates an image forming apparatus. A laser beam printer LBP employing an electrophotographic printing method is illustrated as an example of the image forming apparatus of FIG. 1. Referring to FIG. 1, a sheet of paper 128, as a recording medium or printing medium, is picked up by a pickup roller 110 from a paper cassette 108, fed along a paper conveyance path 130, and then discharged out. An electrophotographic printing operation will now be described in detail.

A photoreceptor drum 102 is electrified by a charger 100 to have a uniform electric potential across its surface. The sheet of paper 128 is picked up from the paper cassette 108 by the pickup roller 110 and transported to a register roller 114 by a transport roller 112. A surface of the photoreceptor drum 102 is exposed to a laser beam L scanned from a laser scanner unit (LSU) 104 that is an exposure device to create an electrostatic latent image on the surface of the photoreceptor drum 102. In this case, the LSU 104 emits the laser beam L corresponding to image data to be printed and exposes the photoreceptor drum 102 with the laser beam L. After a leading edge of the sheet of paper 128 is fed past the register roller 114, the sheet of paper 128 is then fed to a transfer unit 116 in synchronization with a start of exposing the photoreceptor drum 102 to the laser beam L. The electrostatic latent image formed on the photoreceptor drum 102 is then developed into a visible image by toner supplied onto the photoreceptor drum 102 from a developer unit 106. The toner on the photoreceptor drum 102 is transferred onto the sheet of paper 128 by the transfer unit 116 and then the sheet of paper 128 is fed to a fuser unit 118 that includes a heat roller 120 and a pressure roller 122. The toner transferred onto the sheet of paper 128 is fused onto the sheet of paper 128 using heat and pressure applied by the heat roller 120 and the pressure roller 122. Once the sheet of paper 128 having the image fused thereon is discharged out by exit rollers 124 and 126, the printing operation is completed.

The heat roller 120 has a temperature sensor (not illustrated) mounted thereon. A thermistor typically having a negative temperature coefficient (NTC) is used as the temperature sensor. The temperature sensor using the thermistor has a resistance that varies depending on a temperature of the fuser unit 118. A temperature sensing circuit (not illustrated) is connected to the temperature sensor, generates a signal having a voltage level corresponding to a resistance value of the temperature sensor, and applies the signal to a sensor input unit (not illustrated). Typically, the sensor input unit may be an analog-to-digital converter (ADC) or comparator circuit that converts the signal fed from the temperature sensing circuit into digital data having a value corresponding to the voltage level of the signal and outputs the digital data to an engine control processor (not illustrated). An engine control processor detects the temperature of the fuser unit 118 from a data value output by the sensor input unit and controls a heat-generating device through a control circuit for the heat-generating device to control the temperature of the fuser unit 118 to become equal to a target (control or preset) temperature. When the temperature of the fuser unit 118 is higher than the target temperature, the engine control processor turns off the heat-generating device in order to decrease the temperature of the fuser unit 118. However, when the temperature of the fuser unit 118 is lower than the target temperature, the engine control processor turns on the heat-generating device in order to increase the temperature of the fuser unit 118. Thus, the temperature of the fuser unit 118 is maintained constant.

Figure 2:
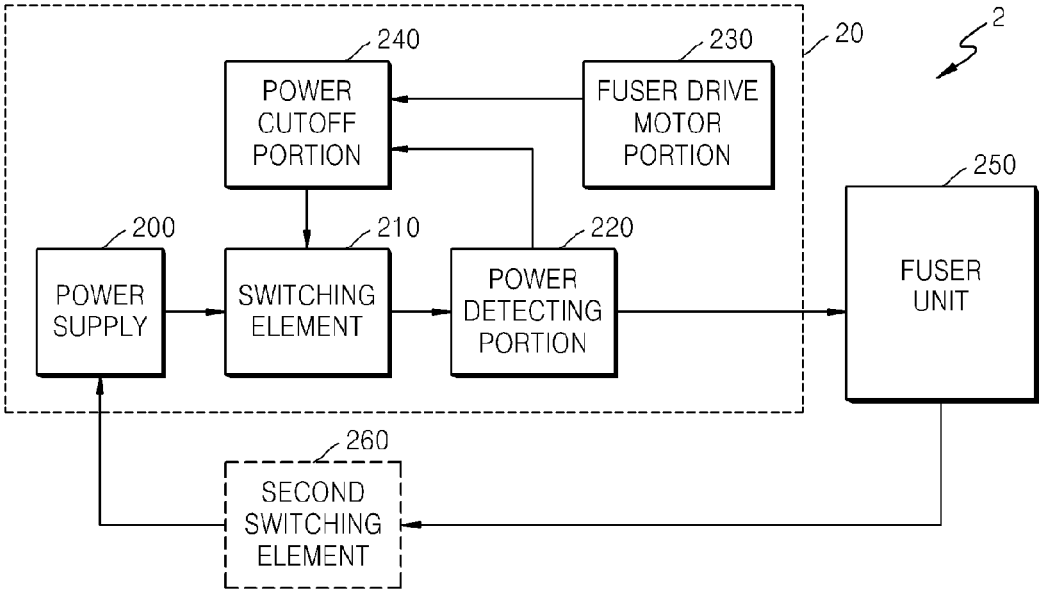
FIG. 2 is a block diagram illustrating an apparatus to protect a fuser unit and an image forming apparatus including the fuser unit protecting apparatus according to an embodiment of the present general inventive concept.

FIG. 2 is a block diagram illustrating an apparatus 20 to protect a fuser unit 250 and an image forming apparatus 2 including the fuser unit protecting apparatus 20 according to an embodiment of the present general inventive concept.

Referring to FIG. 2, the fuser unit protecting apparatus 20 usable in the image forming apparatus 2 according to the present embodiment includes a power detecting portion 220, a fuser drive motor portion 230, and a power cutoff portion 240. The apparatus 20 may further include a power supply 200 and a switching element 210. The image forming apparatus 2 includes the fuser unit protecting apparatus 20 and the fuser unit 250.

The power detecting portion 220 detects power that is supplied to the fuser unit 250. According to the present embodiment, when the image forming apparatus 2 operates normally, a temperature of the fuser unit 250 increases to and is at a preset target temperature. To achieve this, a current loop is formed with the power detecting portion 220, the fuser unit 250, and a second switching element 260 and is supplied with a voltage that is input by the power supply 200 when the second switching element 260 is turned on. The power detecting portion 220 detects whether a current flows in the current loop.

The fuser drive motor portion 230 drives the fuser unit 250 and provides a motor rotation signal indicating rotation of a motor driven by the fuser drive motor portion 230 when the motor rotates in order to prevent an overshoot current from being supplied to the fuser unit 250 after the motor ceases to rotate. The motor rotates a component of the fuser unit 250, such as a roller to feed the printing medium 128 along the conveyance path 130 during a fusing operation of the fuser unit 250. When using a motor in the fuser drive motor portion 230 that does not provide a signal to confirm rotation of the motor, a current that is applied to rotate the motor may be detected. Then a signal indicating the rotation of the motor may be generated using the detected current.

Therefore, the fuser unit 250 may have a heating operation of a heating element to fuse an image on the printing medium using heat generated by the current flow and a rotation (moving) operation of a rotating element to feed or move the printing medium to pass through the fuser unit 250 using rotation power. The rotating element may be disposed in the fuser unit 250 to receive a rotation power from the motor or the rotating element may be disposed in the fuser drive motor portion 230 to rotate a roller of the fuser unit 250. The motor rotation signal may indicate a signal to indicate rotation (movement or operation) of at least one of the motor, the rotating element, and the roller of the fuser unit 250.

Figure 5:
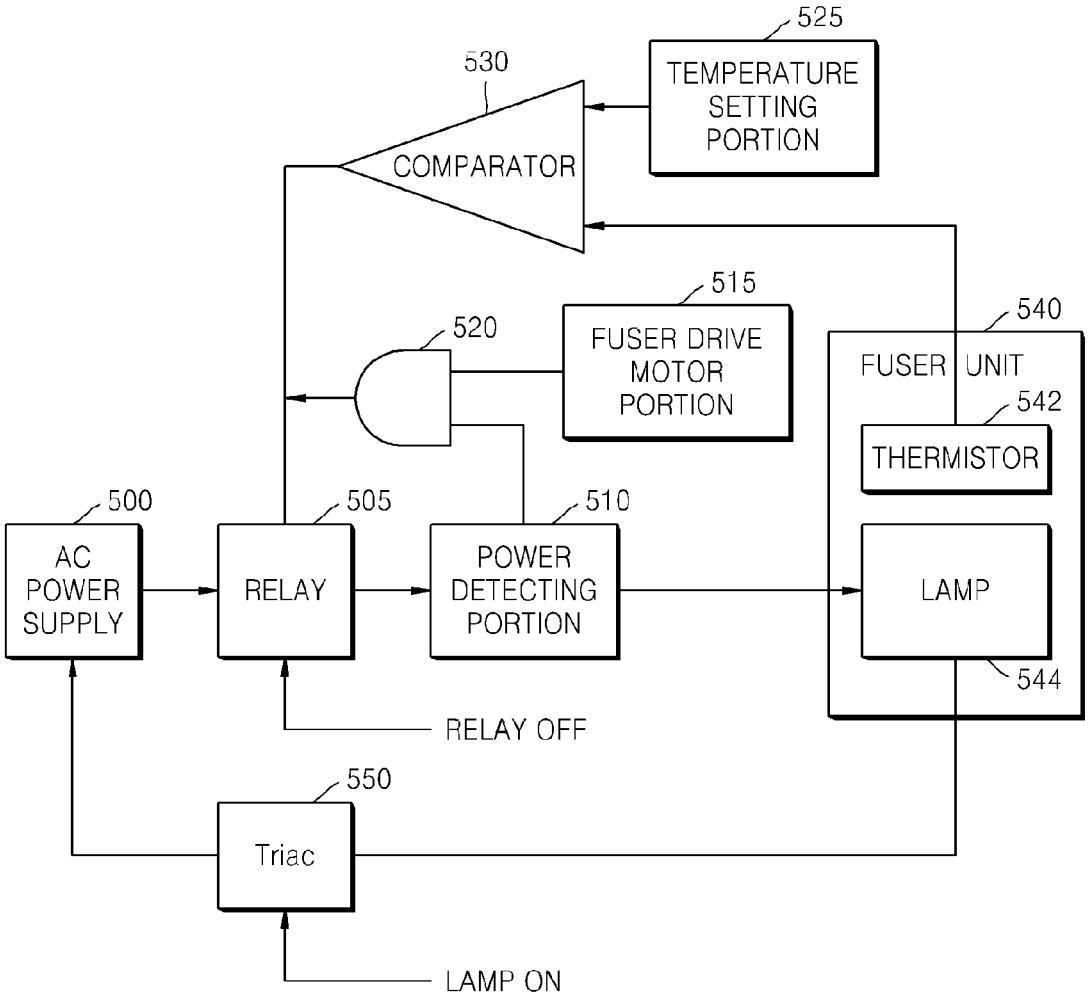
FIG. 5 is a block diagram illustrating an image forming apparatus according to an embodiment of the present general inventive concept.
Figure 7A:
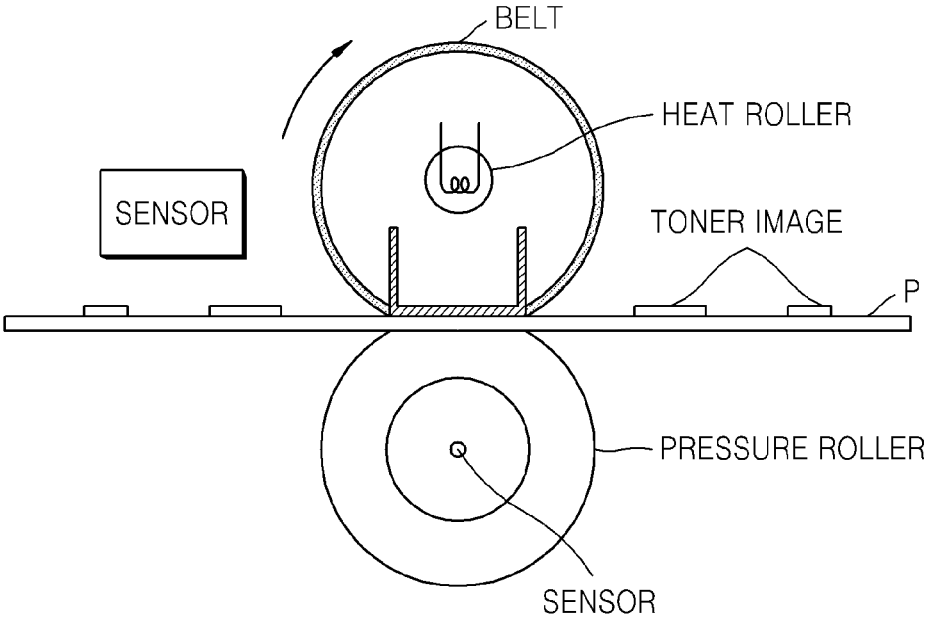
FIG. 7A is a view illustrating a fuser motor rotation sensor to sense rotation of a fuser drive motor portion of FIG. 5.

FIG. 7A illustrates a fuser motor rotation sensor to detect rotation of a motor in a fuser driver motor portion (515 in FIG. 5). The fuser motor rotation sensor may be one or more sensors disposed to detect the rotation of the motor or the rotation element thereof. When a motor rotation signal is not output from the fuser drive motor portion 230 and the power detecting portion 220 detects power that is supplied to the fuser unit 250, the power cutoff portion 240 cuts off the power supplied to the fuser unit 250. In one embodiment, the power cutoff portion 240 uses a logic AND circuit to perform a logic AND operation on the motor rotation signal output from the fuser drive motor portion 230 and a signal indicating whether a flow of current is detected by the power detecting portion 220 and create a power cutoff signal, thereby controlling on/off operations of the switching element 210.

The switching element 210 is controlled by the power cutoff portion 240 to switch on and off the power that is supplied from the power supply 200 to the fuser unit 250. The switching element 210 may be a relay that is set to a switching on state by a default operation. The default operation is an operation to perform a predetermined switching operation when no other signal is input thereto.

When the motor in the fuser drive motor portion 230 is a Brushless DC (BLDC) motor, the motor rotation signal may be a signal generated from a hall sensor.

The fuser unit 250 fixes a toner image onto a printing medium and may include a lamp and a thermistor that detects a temperature of the lamp.

Figure 3:
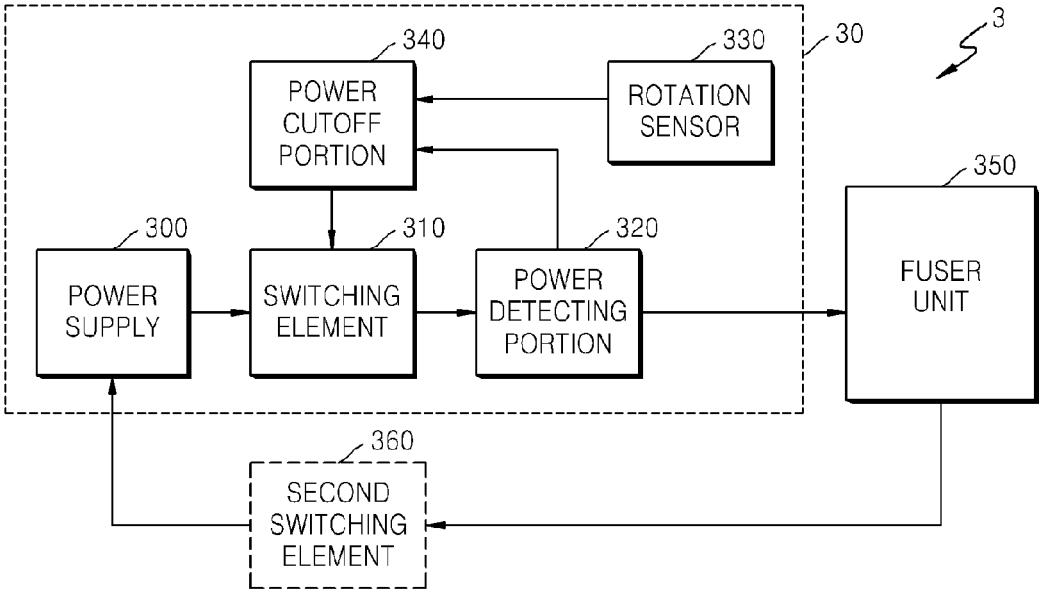
FIG. 3 is a block diagram illustrating an apparatus to protect a fuser unit and an image forming apparatus including the fuser unit protecting apparatus according to an embodiment of the present general inventive concept.

FIG. 3 illustrates an apparatus 30 to protect a fuser unit and an image forming apparatus 3 including the fuser unit protecting apparatus 30 according to an embodiment of the present general inventive concept.

Referring to FIG. 3, the fuser unit protecting apparatus 30 usable in the image forming apparatus 3 according to the present embodiment includes a power detecting portion 320, a rotation sensor 330, and a power cutoff portion 340. The apparatus 30 may further include a power supply 300 and a switching element 310. The image forming apparatus 3 includes the fuser unit protecting apparatus 30 and the fuser unit 350.

The power detecting portion 320 detects power that is supplied to the fuser unit 350. According to the present embodiment, when the image forming apparatus 2 operates normally, a temperature of the fuser unit 350 increases to and is at a preset target temperature. To achieve this, a current loop is formed with the power detecting portion 320, the fuser unit 350, and a second switching element 360 and supplied with a voltage that is input by the power supply 300 when the second switching element 360 is turned on. The power detecting portion 320 detects whether a current flows in the current loop.

Figure 7B:
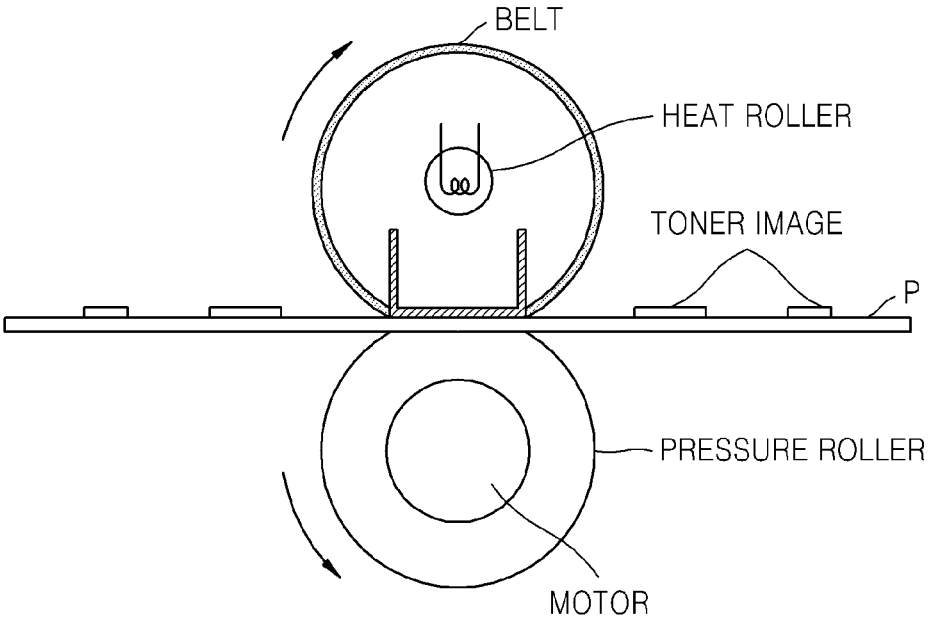
FIG. 7B is a view illustrating a rotation sensor of FIG. 3.

The rotation sensor 330 detects rotation of one of a heat roller, a pressure roller, and a heating film (or belt). FIG. 7B illustrates an example of the fuser unit 350 to detect rotation of the one of the heat roller, a pressure roller and a heating film (belt).

When the rotation is not detected by the rotation sensor 330 and the power supplied to the fuser unit 350 is detected by the power detecting portion 320, the power cutoff portion 340 cuts off the power supplied to the fuser unit 350. In one embodiment, the power cutoff portion 340 uses a logic AND circuit to perform a logic AND operation on a motor rotation signal output from the rotation sensor 330 and a signal indicating a flow of current detected by the power detecting portion 320 and create a power cutoff signal, thereby controlling on/off operations of the switching element 310.

The power supply 300 supplies power (typically alternating current (AC) power) to the fuser unit 350.

The switching element 310 is controlled by the power cutoff portion 340 to switch on and off the power that is supplied from the power supply 300 to the fuser unit 350. The switching element 310 may be a relay that is set switched on by default.

The fuser unit 350 fuses a toner image onto a printing medium and may include a lamp and a thermistor that detects a temperature of the lamp.

Figure 4:
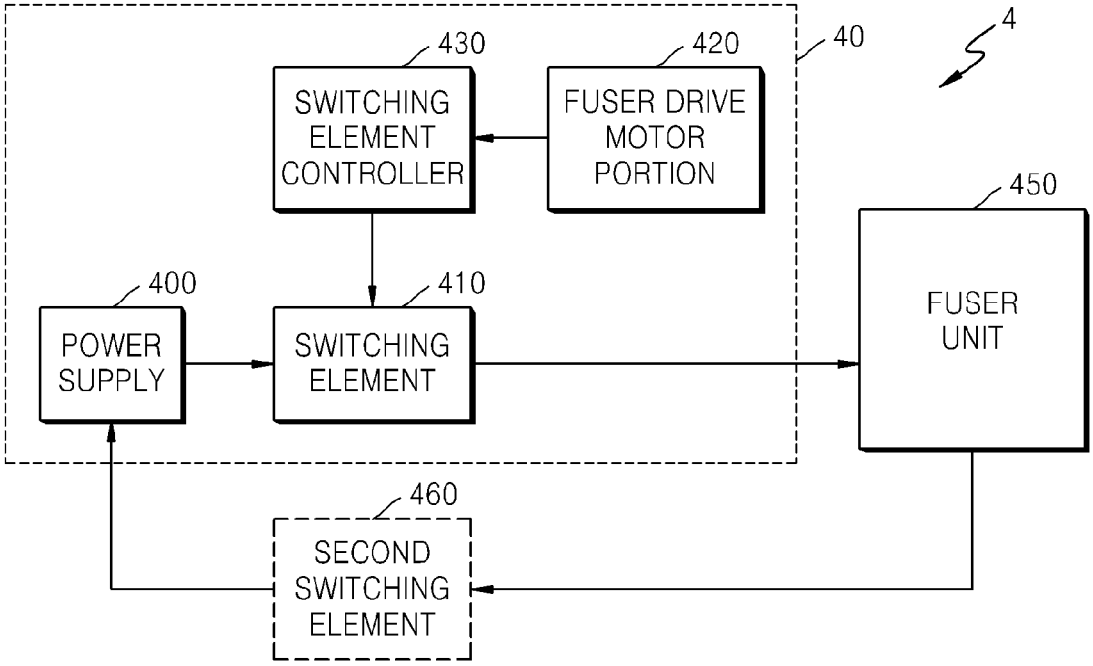
FIG. 4 is a block diagram illustrating an apparatus to protect a fuser unit and an image forming apparatus including the fuser unit protecting apparatus according to an embodiment of the present general inventive concept.

FIG. 4 is a block diagram of an apparatus 40 for protecting a fuser unit and an image forming apparatus 4 including the fuser unit protecting apparatus 40 according to another embodiment of the present general inventive concept. Referring to FIG. 4, the fuser unit protecting apparatus 40 for use in the image forming apparatus 4 according to the present embodiment includes a switching element 410, a fuser drive motor portion 420, and a switching element controller 430. The apparatus 40 may further include a power supply 400. The image forming apparatus 4 includes the fuser unit protecting apparatus 40 and a fuser unit 450.

The switching element 410 switches on and off power that is supplied from the power supply 400 to the fuser unit 450. The switching element 410 may be a relay that is set switched off by default.

The switching element 410 is located on an AC loop path including the power supply 400, the switching element 410, the fuser unit 450, and a second switching element 460. The switching element 410 is set to a switching off state by a default operation. When the fuser drive motor portion 420 detects rotation of a fuser drive motor, the switching element 410 is turned on in response to output signal of the switching element controller 430, without detecting of a flow of current in the AC loop path.

The fuser drive motor portion 420 drives the fuser unit 450 and provides a motor rotation signal when the fuser drive motor in the fuser drive motor portion 420 rotates. When using a motor in the fuser drive motor portion 420 that does not provide a signal confirming rotation of the motor, a flow of current that is supplied to rotate the motor may be detected to create a signal indicating the rotation of the motor.

When the motor rotation signal is output from the fuser drive motor portion 420, the switching element controller 430 controls the switching element 410 so as to supply the power to the fuser unit 450. When the motor rotation signal is not output from the fuser drive motor portion 420, the switching element controller 430 controls the switching element 410 so as not to supply the power to the fuser unit 450. The switching element controller 430 may be realized by a Wired-OR connection between the motor rotation signal output from the fuser drive motor portion 420 and a control signal for the switching element controller 430 output from a control unit (not shown).

The fuser unit 450 fuses a toner image onto a printing medium and typically includes a lamp and a thermistor. In the present embodiment, a sensor for directly detecting rotation of a heat roller, a pressure roller, or a heat film in the fuser unit 450 may be used instead of detecting the motor rotation signal.

A fuser unit protecting apparatus according to another embodiment may include a rotation sensor, a switching element, and a power cutoff portion. The rotation sensor detects rotation of one of a fuser belt, a heat roller and a pressure roller in a fuser unit. The switching element switches on and off power supplied from a power supply to the fuser unit. When the rotation is not detected by the rotation sensor, the power cutoff portion cuts off the power supplied to the fuser unit. That is, when the rotation sensor does not detect the rotation of one of the fuser belt, the heat roller and the pressure roller, the power cutoff portion controls the switching element so as to cut off the power supplied to the fuser unit.

FIG. 5 is a block diagram illustrating an image forming apparatus. The image forming apparatus of FIG. 5 illustrates an example of the image forming apparatus of FIG. 2. Referring to FIG. 5, in order to increase a temperature of a fuser unit 540 to a target temperature, a signal Lamp_On is applied to a Triac 550 by a control unit (not illustrated) to form a current loop including a power detecting portion 510, a lamp 544, the Triac 550, and an AC power supply 500, and the current loop is formed by a voltage input by the AC power supply 500

However, when the image forming apparatus operates normally, a roller and/or a belt in the fuser unit 540 may be rotated using a fuser drive motor portion 515 according to a basic operating principle. That is, in order to increase a lifetime of the fuser unit 540 while preventing deformation thereof, an AC current loop is formed only when the belt and roller in the fuser unit 540 rotate according to a driving operation of the fuser drive motor portion 515 so that the temperature of the fuser unit 540 reaches a target temperature.

When the temperature of the fuser unit 540 continues to rise above the target temperature due to abnormal reasons, a comparator 530 generates a signal to turn off a relay 505 so that the fuser unit 540 is maintained at a temperature preset by a temperature setting portion 525 for hardware protection.

However, if a temperature overshoot occurs due to a rapid temperature rise after a motor ceases to rotate, the fuser unit 540 may not be protected properly due to the overshoot.

Thus, to prevent an overshoot after the motor ceases to rotate, the fuser drive motor portion 515 initially provides a signal indicating rotation of the motor when the motor rotates. When using a motor in the fuser drive motor portion 515 that does not provide a signal confirming rotation of the motor, a current that is supplied to rotate the motor may be detected. Then a signal indicating the rotation of the motor is generated using the detected current.

To increase the temperature of the fuser unit 540, an alternating current must be applied to the lamp. Furthermore, monitoring a flow of the alternating current allows more accurate and prompt protection of the fuser unit 540 than driving a hardware protection circuit by monitoring a rise in the temperature of the fuser unit 540. Thus, the power detecting portion 510 detects the alternating current flowing in the AC loop and outputs a signal indicating the flow of the alternating current. The power detecting portion 510 may detect the alternating current through the AC power supply 500 directly input AC power. Also, the power detecting portion 510 may be located before or after the Triac 500, within the fuser unit 540, or on a wire or harness that is provided to the fuser unit 540, and may detect the alternating current.

A power cutoff portion 520 performs a logic AND operation on a motor rotation signal output from the fuser drive motor portion 515 and a signal indicating the flow of alternating current in the AC loop detected by the power detecting portion 220. The power cutoff portion 520 also delivers the signal to turn off the relay 505 to the relay 505 when two conditions are satisfied, that is, when the motor ceases to rotate and simultaneously when the alternating current flows in the AC loop.

Satisfying the conditions in which the motor ceases to rotate and in which the alternating current flows in the AC loop means that abnormal driving occurs. That is, conditions for protecting the fuser unit 540 according to an embodiment of the present general inventive concept is when a signal indicating no rotation of the motor in the fuser drive motor unit 515 is detected and simultaneously the alternating current is flowing in the AC loop, causing the temperature of the fuser unit 540 to rise. In this case, the power cutoff portion 520 determines that conditions are abnormal and delivers a signal to cut off the relay 505 to the relay 505 in order to open the AC loop.

Figure 6:
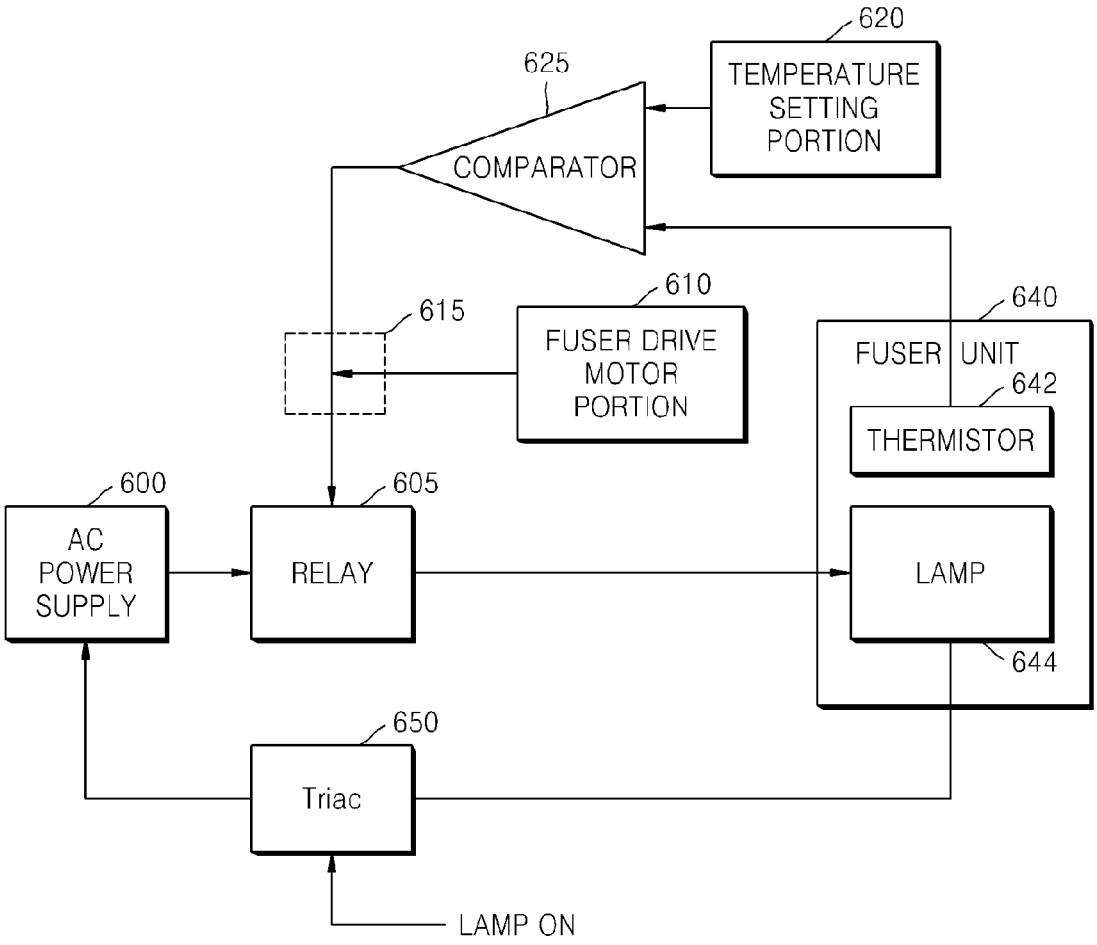
FIG. 6 is a block diagram illustrating an image forming apparatus according to an embodiment of the present general inventive concept.

FIG. 6 is a block diagram illustrating an image forming apparatus. The image forming apparatus of FIG. 6 is an example of the image forming apparatus of FIG. 4. A relay 605 is placed on an AC loop path formed with an AC power supply 600, the relay 605, a lamp 644, and a Triac 650. The relay 605 is set to a switching off state by a default operation. When a fuser drive motor portion 610 detects rotation of a fuser drive motor, the relay 605 is turned on in response to an output signal a relay controller 615 without detecting of a flow of current in the AC loop. The relay controller 615 may be realized by a Wired-OR connection between a signal output from the fuser drive motor portion 610 and a signal output from a comparator 625.

When a signal Lamp On is applied to the Triac 650 by a fuser unit controller (not illustrated) and the relay 605 is turned on, power is supplied to the AC loop path to heat the fuser unit 640. That is, when rotation of a fuser drive motor by the fuser drive motor portion 610 is detected in condition that the relay 605 is set to a switching off state by a default operation, a signal indicating the rotation of the fuser drive motor may be used directly as a control signal for the relay 605 without detecting of a flow of current in the AC loop.

According to the present embodiment, the relay 605 is switched on only when the fuser drive motor rotates and switched off when the fuser unit 640 stops a printing operation, thereby preventing an abnormal rise in a temperature of the fuser unit 640 while protecting the fuser unit 640 against deformation.

Meanwhile, when the temperature of the fuser unit 640 continues to rise above a target temperature due to abnormal reasons, the comparator 625 compares a temperature detected by a thermistor 642 with a temperature set by a temperature setting portion 620. When the detected temperature is greater than the set temperature, the comparator 625 generates a signal to turn off the relay 605 so as to protect the fuser unit 640.

Figure 8:
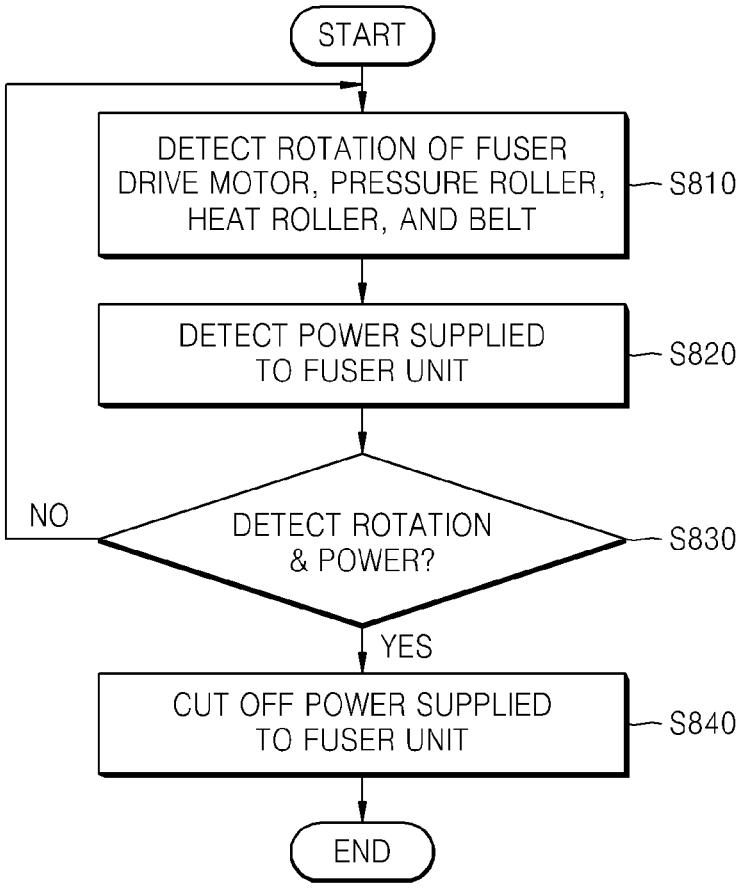
FIG. 8 is a flowchart illustrating a method of protecting a fuser unit in an image forming apparatus according to an embodiment of the present general inventive concept.

FIG. 8 is a flowchart illustrating a method of protecting the fuser unit 250 (350) in the image forming apparatus 2 (3) of FIG. 2 (3) according to an embodiment of the present general inventive concept.

Referring to FIG. 8, rotation of a motor in the fuser drive motor portion 230 (the rotation sensor 330) is detected in order to prevent an overshoot current from being supplied to the fuser unit 250 (350) when the motor ceases to rotate at operation S810. In the operation S810, rotation of the pressure roller, the heat roller, and the belt may be detected instead of the rotation of the motor.

The power detecting portion 220 (320) detects power supplied to the fuser unit 250 (350) at operation S820. According to the present general inventive concept, when the image forming apparatus 2 (3) operates normally, a temperature of the fuser unit 250 (350) should rise to a preset target temperature. To achieve this, a current loop including the power detecting portion 220 (320), the fuser unit 250 (350), and the second switching element 260 (360) is formed by a voltage that is input by the power supply 200 (300) when the second switching element 260 (360) is turned on. The power detecting portion 220 (320) detects whether a current is flowing in the loop.

When the motor ceases to rotate and the power supplied to the fuser unit 250 (350) is detected at operation S830, the power cutoff portion 240 (340) controls the switching element 210 (310) to cut off the power supplied to the fuser unit 250 (350) at operation S840.

That is, when the motor rotation signal is not output from the fuser drive motor portion 230, when the rotation of one of the pressure roller, the heat roller, and the belt is not detected by the rotation sensor 330, and when the power detecting portion 220 (320) detects power supplied to the fuser unit 250 (350), the power cutoff portion 240 (340) cuts off the power supplied to the fuser unit 250 (350).

In one embodiment, the power cutoff portion 240 (340) uses a logic AND circuit to perform a logic AND operation on a motor rotation signal output from the fuser drive motor portion 230 and a signal indicating a flow of current detected by the power detecting portion 220 (320) and create a power cutoff signal, thereby controlling on/off operations of the switching element 210 (310).

The switching element 210 (310) is controlled by the power cutoff portion 240 (340) to switch on and off the power that is supplied from the power supply 200 (300) to the fuser unit 250 (350). Typically, the switching element 210 (310) is a relay that is set switched on by default.

The method of protecting a fuser unit according to the present embodiment includes detecting whether a motor ceases to rotate and whether a current flows in a loop circuit of a lamp in the fuser unit to which an alternating current is applied, determining, upon simultaneous occurrence of the two conditions, the occurrence as abnormal, and cutting off an AC power supply.

Furthermore, when the fuser unit ceases to rotate and an AC voltage or a current applied from the AC power supply to the fuser unit is detected, the conditions are determined as abnormal conditions that may induce deformation of the fuser unit, and thus the relay is turned off.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An apparatus to protect a fuser unit in an image forming device, the apparatus comprising:

a fuser drive motor portion to drive the fuser unit;

a power detecting portion to detect power that is supplied to the fuser unit and generate a corresponding output; and a power cutoff portion to receive a motor rotation signal from the fuser drive motor portion, receive the output of the power detection portion, and according to the received motor rotation signal of the fuser drive motor portion and the received output of the power detection portion, cut off the power supplied to the fuser unit when the motor rotation signal is not output from the fuser drive motor portion and the output from the power detecting portion is that power is supplied to the fuser unit.

2. The apparatus of claim 1, further comprising:

a power supply to supply power to the fuser unit; and a switching element to be controlled by the power cutoff portion and to switch on and off the power supplied from the power supply to the fuser unit.

3. The apparatus of claim 2, wherein the switching element is a relay that is set switched on by default.

4. The apparatus of claim 1, wherein when a motor in the fuser drive motor portion is a Brushless DC (BLDC) motor, the motor rotation signal is a signal using a hall sensor.

5. An image forming device comprising:

a fuser unit to fuse an image onto a printing medium;

a power supply to supply power to the fuser unit;

a switching element to switch on and off the power supplied from the power supply to the fuser unit;

a fuser drive motor portion to drive the fuser unit;

a power detecting portion to detect the power supplied to the fuser unit and generate a corresponding output; and a power cutoff portion to receive a motor rotation signal from the fuser drive motor portion, receive the output of the power detection portion, and according to the received motor rotation signal of the fuser drive motor and the received output of the power detection portion, cut off the power supplied to the fuser unit when the motor rotation signal is not output from the fuser drive motor portion and the output from the power detecting portion is that power is supplied to the fuser unit.

6. An apparatus to protect a fuser unit in an image forming device, the apparatus comprising:

a rotation sensor to detect rotation of one of a heat roller, a pressure roller, and a heating film, and to generate a corresponding output;

a power detecting portion to detect power that is supplied to the fuser unit and generate a corresponding output; and a power cutoff portion to receive the output of the rotation sensor, receive the output of the power detecting portion, and according to the received output of the rotation sensor and the received output of the power detection portion, cut off the power supplied to the fuser unit when the rotation is not detected by the rotation sensor and the power detecting portion detects that power is supplied to the fuser unit.

7. The apparatus of claim 6, further comprising:

a power supply to supply power to the fuser unit; and a switching element controlled by the power cutoff portion and to switch on and off the power supplied from the power supply to the fuser unit.

8. The apparatus of claim 7, wherein the switching element is a relay that is set switched on by default.

9. An image forming device comprising:

a fuser unit to fuse an image onto a printing medium;

a power supply to supply power to the fuser unit;

a switching element to switch on and off the power supplied from the power supply to the fuser unit;

a rotation sensor to detect rotation of one of a heat roller, a pressure roller, and a heating film, and to generate a corresponding output;

a power detecting portion to detect the power supplied to the fuser unit and generate a corresponding output; and a power cutoff portion to receive the output of the rotation sensor, receive the output of the power detecting portion, and control the switching element according to the received output of the rotation sensor and the received output of the power detection portion, to cut off the power supplied to the fuser unit when the rotation is not detected by the rotation sensor and the power detecting portion detects that power is supplied to the fuser unit.

10. An apparatus to protect a fuser unit in an image forming device, the apparatus comprising:

a switching element to switch on and off power supplied from a power supply to the fuser unit and to be set to switch off by a default operation.

a fuser drive motor portion to drive the fuser unit; and a switching element controller to receive a motor rotation signal from the fuser drive motor portion, to control the switching element according to the received motor rotation signal of the fuser drive motor portion so as to supply the power to the fuser unit when the motor rotation signal is output from the fuser drive motor portion, and to control the switching element so as not to supply the power to the fuser unit when the motor rotation signal is not output from the fuser drive motor portion.

11. The apparatus of claim 10, wherein the switching element is a relay.

12. An image forming device comprising:

a fuser unit to fuse an image onto a printing medium;

a power supply to supply power to the fuser unit;

a switching element to switch on and off power that is supplied from the power supply to the fuser unit;

a fuser drive motor portion to drive the fuser unit; and a switching element controller to receive a motor rotation signal from the fuser drive motor portion, to control the switching element according to the received motor rotation signal of the fuser drive motor portion so as to supply the power to the fuser unit when a motor rotation signal is output from the fuser drive motor portion, and to control the switching element so as not to supply the power to the fuser unit when the motor rotation signal is not output from the fuser drive motor portion.

13. A method of protecting a fuser unit in an image forming device, the method comprising:

detecting whether a motor in a fuser drive motor portion rotates;

detecting power that is supplied to the fuser unit; and according to the detected rotation of the motor and the detected power that is supplied to the fuser unit, cutting off the power supplied to the fuser unit when the motor ceases to rotate and the power is supplied to the fuser unit.

14. The method of claim 13, wherein the detecting of whether the motor rotates comprises detecting rotation of one of a belt, a pressure roller, and a heat roller by the fuser drive motor portion.

15. A method of protecting a fuser unit in an image forming device, the method comprising:

detecting movement of the fuser unit and power supplied to the fuser unit; and cutting off the power supplied to the fuser unit according to the detected movement and power.

16. An apparatus to protect a fuser unit in an image forming apparatus, the apparatus comprising:

a detecting unit to detect movement of the fuser unit and power supplied to the fuser unit; and a controller unit to cut off the power supplied to the fuser unit according to the detected movement and power.

* * * * *